United States Patent [19]

Dietz et al.

[11] Patent Number: 4,859,295

[45] Date of Patent: Aug. 22, 1989

[54] METHOD FOR THE PRECIPITATION OF MERCURY BY ELECTROLYSIS

[76] Inventors: Wolfgang Dietz, Friedlandstr. 14, D-6454 Bruchköbel; Freidel Kuhn, An der Berstr. 5, D-6000 Frankfurt am Main 56, both of Fed. Rep. of Germany

[21] Appl. No.: 171,625

[22] Filed: Mar. 22, 1988

[30] Foreign Application Priority Data

Mar. 19, 1987 [DE] Fed. Rep. of Germany .... 3709359

[51] Int. Cl.[4] ..... C25C 1/16

[52] U.S. Cl. ..... 204/105 R; 204/128; 204/130; 204/140

[58] Field of Search ..... 204/64 R, 128, 105 R, 204/130, 140

[56] References Cited

U.S. PATENT DOCUMENTS 4,640,751 2/1987 Dyvik et al. ..... 204/105 R

*Primary Examiner*—John F. Niebling
*Assistant Examiner*—David G. Ryser
*Attorney, Agent, or Firm*—Oldham & Oldham Co.

[57] ABSTRACT

A method is described for the precipitation by electrolysis of metallic mercury from an electrolyte containing $Hg_2Cl_2$ in suspension by cathodic reduction.

The method includes an electrolysis cell containing $Hg_2Cl_2$ in which chlorine developed at the anode during the course of oxidation can migrate without impediment to the cathode area of the cell. The electrolyte containing $Hg_2Cl_2$ is subjected to electrolysis wherein chlorine is formed at the anode, chlorine reacts in situ with the $Hg_2Cl_2$ to form $HgCl_2$, and $HgCl_2$ is reduced at the cathode to metallic mercury with the formation of chloride ions. The $Hg_2Cl_2$ in the electrolyte is formed by oxidation of gaseous mercury with $HgCl_2$, frequently when process gases are purified.

4 Claims, No Drawings

METHOD FOR THE PRECIPITATION OF MERCURY BY ELECTROLYSIS

The invention relates to a method for the precipitation by electrolysis of metallic mercury from a electrolyte wherein the electrolyte containing mercury-(I)-chloride ($Hg_2Cl_2$) in suspension reacts with chlorine which oxidizes the mercury (I) chlorine to soluble mercury-(II)-chloride ($HgCl_2$), which is cathodically reduced by electrolysis under the influence of chlorine at the anode to liquid mercury.

The method according to the invention is advantageously employed whenever mercury-(I)-chloride available in suspension is to be precipitated and to be recovered as metallic mercury. Mercury-(I)-chloride is for instance frequently recovered in the purification process of gases, which are obtained in a reactor with the aid of a solution of mercury-(II)-chloride.

A method of this kind has been described by European Patent Publication No. 179,040. The chlorine gas developed in electrolysis is deducted from the electrolysis vessel and is conducted to a reactor wherein oxidation had taken place. While this has the advantage that the chlorine gas required in the process is produced by the method itself, a particular chlorine gas duct between the electrolysis cell and the oxidation reactor is required. In this connection, particular care must be taken that the poisonous chlorine gas is not blown into the environment. By suitable measures, the chlorine gas, furtheron, has to be introduced, finely dispersed, into the suspension in the reactor in order to be able to carry out the oxidation reaction.

That publication does not describe the exact construction of the electrolysis cell employed. It can be assumed however that an electrolysis cell is used which is divided by a diaphragm since the prior art according to German Auslegeschrift No. 2,011,610 advises in general to keep chlorine away from the cathode in the electrolysis process since chlorine is reduced at the cathode thereby diminishing the current yield of the metal precipitation taking place (compare in this connection particularly column 8, line 63 and following of German Auslegeschrift No. 2,011,610).

The present invention avoids this disadvantage. It has as object to provide a method for the precipitation of metallic mercury by electrolysis from an electrolyte including the features mentioned in the beginning, which excells by a sensibly simplified procedure in combination with a sensibly increased yeild of precipitated metallic mercury.

To solve this problem the invention is characterized in that when employing an electrolysis cell wherein the chlorine developed at the anode during the course of the oxidation can migrate without any impediment into the cathode area of the cell, the chlorine developed during electrolysis in the electrolysis cell is employed in situ for the oxidation of the mercury-(I)-chloride to soluble mercury-(II)-chloride.

By so proceeding, the particular flow of the chlorine gas developed during the electrolysis to the oxidation reactor is dispensed with. Oxidation and electrolysis are rather carried out in one and the same electrolysis cell so that the chlorine gas developing during the course of electrolysis can, directly and without any impediment, also migrate into the cathode area of the cell. The gaseous chlorine developing during the course of electrolysis, in general, dissolved in the electrolyte and is transported together with the electrolyte, supported if necessary by a pump or similar device. The whole volume of the electrolyte is therefore available for the oxidation of the mercury-(I)-chloride to mercury-(II)-chloride by means of the (gaseous or dissolved, respectively) chlorine.

To carry out the method as described, a fixed-bed electrolysis cell is advantageously employed, which does not include a separate anolyte circuit but a diaphragm preventing the direct contact to the counter electrode but does not impede the material exchange. It has become known in a basic embodiment through Applicant's German Patent Specification No. 2,622,497 and, in an improved embodiment, through German Patent Specification No. 2,904,539. A further improved embodiment has been described in Applicant's German Patent Specification No. 3,532,537. All these embodiments basically may be employed for the invention, preferably using the features mentioned above.

The method according to the invention is so carried out that the electrolyte, at least in the beginning, is employed in such a concentration of mercury-(I)-chloride and/or that the electrolysis voltage and thereby the electrolysis current, at least in the beginning, is employed at such a height that metallic mercury is precipitated at the cathode and drips off therefrom. It can be withdrawn from the bottom of the electrolysis cell. As the material for the cathode, iron, silver, nickel, copper, cadmium, aluminum, zinc, tin or an alloy of these metals is suited.

Deviating from the suggestion of German Auslegeschrift No. 2,011,610 already mentioned, anodically developed chlorine is employed for oxidation of the difficulty soluble mercury-(I)-chlorine which dissolves this salt so that the starting suspension of the electrolysis is made usable.

Experiments have shown that it might be sufficient to apply the electrolysis voltage, and hence the electrolysis current, only for a relatively short period of time at the beginning at a voltage peak, that is until a first mercury film has formed on the surface of the amalgam cathode. Subsequently, the voltage may be reduced to normal values and the mercury continues to precipitate in metallic form on the surface of the amalgam cathode. The concentration of $Hg_2Cl_2$ in the electrolyte is corresponding.

The method according to the invention is based on the theory that at the anode of the electrolysis device, $Cl^-$ passes into $Cl_2$. The $Cl_2$ reacts with the $Hg_2Cl_2$ available in the form of suspension and results in $2Hg_2Cl_2$ which is dissolved in the electrolyte.

At the cathode, $HgCl_2$ is reduced to $Hg^\circ + 2\ Cl^-$. This $Cl^-$ is then available for the oxidation of the cathode.

As electrochemical equations, the following can be written: Starting reaction (as an example only) on how $Hg_2Cl_2$ may be developed as a suspension in an electrolyte:

(A) $Hg^\circ$ (gaseous) + $HgCl_2$ (soluble) = $Hg_2Cl_2$ (difficulty soluble)

Oxidation:

(B) $Hg_2Cl_2$ (difficulty soluble) + $Cl_2$ (gaseous) = $2HgCl_2$ (soluble)

Electrolysis:

(C) $HgCl_2$ (soluble) + electrical energy = $Hg^\circ$ (liquid) + $Cl_2$ (gaseous)

Result:

From $Hg^\circ$ (gaseous) + Energy, $Hg^\circ$ (liquid) is obtained.

The $Cl_2$ (gaseous) developed in step C is used as such, and in situ, in step B.

These electrochemical reactions constitute at least a rough picture of the processes really occurring during electrolysis. In reality, these processes may be more complicated, for instance via corresponding complexes or multi reactions.

In one embodiment, where copper was taken as the cathode material, the electrolyte employed had the following composition:

45 g/l $Hg_2Cl_2$ as suspension 30 g/l sulfuric acid 10 g/l chloride.

The anodic current density was 300 $A/m^2$. Since an expanded metal was employed, this value is referred to the total area inclusive of the gaps. The cathodic current density also amounted to 300 $A/m^2$.

The initial contents of water-insoluble $Hg_2Cl_2$ was equal to the concentration already mentioned of the suspension of 45 g/l. The initial current density amounted to 600 $A/cm^2$.

I claim:

1. A method for the precipitation by electrolysis of metallic mercury from an electrolyte containing mercury-(I)-chloride, said method comprising:

(a) providing an electrolysis cell containing an anode, a cathode and an electrolyte containing mercury-(I)-chloride, and in which chlorine developed at the anode during the course of oxidation can migrate without impediment to the cathode area of the cell; and (b) subjecting said electrolyte to electrolysis, whereby:

(1) chlorine is formed at the anode, (2) said chlorine reacts in situ with mercury-(I)-chlorine to form mercury-(II)-chlorine, and (3) mercury-(II)-chloride is reduced at the cathode to metallic mercury with the formation of chloride ions.

2. A method according to claim 1, in which a fixed-bed electrolysis cell is employed.

3. A method according to claim 1 or 2, in which iron, silver, nickel, copper, cadmium, aluminum, zinc, tin or an alloy of these metals is used as the cathode material.

4. A method according to claim 1, in which the mercury-(I)-chloride in the electrolyte is formed by oxidation of metallic mercury in a gas with mercury-(II)-chloride.

* * * * *